United States Patent [19]

Kubo

[11] Patent Number: 4,908,898

[45] Date of Patent: Mar. 20, 1990

[54] CLEANING ROLLER IN BOWLING LANE MAINTENANCE SYSTEM

[75] Inventor: Chikanari Kubo, Sagamihara, Japan

[73] Assignee: Eishin Technology Company, Limited, Yamato, Japan

[21] Appl. No.: 255,912

[22] Filed: Oct. 11, 1988

[30] Foreign Application Priority Data

Jul. 13, 1988 [JP] Japan ..... 63-174160

[51] Int. Cl.[4] ..... A47L 11/00

[52] U.S. Cl. ..... 15/98; 29/122; 29/132

[58] Field of Search ..... 15/52, 98, 99; 100/162 B; 68/244; 29/122, 132

[56] References Cited

U.S. PATENT DOCUMENTS

| | | | |
|---|---|---|---|
| 1,317,713 | 10/1919 | Linder | 29/122 |
| 1,956,347 | 4/1934 | Gearhart et al. | 29/122 |
| 2,191,144 | 2/1940 | Hornbostel | 29/122 |
| 2,685,548 | 8/1954 | Drozdowski | 68/244 |
| 2,921,426 | 1/1960 | Heth | 100/162 B |

*Primary Examiner*—Edward L. Roberts

*Attorney, Agent, or Firm*—Jordan and Hamburg

[57] ABSTRACT

A cleaning roller rotatably driven to wipe off a liquid cleaner applied to a floor by an applying roller includes a core rotatably supportable at the opposite ends thereof and a resilient body mounted about the core and having one end inwardly spaced away from each of the opposite ends of the core, the external diameter of the resilient body progressively increasing from each of the opposite ends of the resilient body toward the central portion thereof.

8 Claims, 1 Drawing Sheet

CLEANING ROLLER IN BOWLING LANE MAINTENANCE SYSTEM

BACKGROUND OF THE INVENTION

1. Field of the Invention

The present invention relates to an improved cleaning roller suitable for use in a cleaner applying device for bowling lane maintenance machines, floor cleaning machines and the like.

2. Description of the Prior Art

To play the bowling game as a sport in a proper manner, it is required that the bowling lanes always be in their best condition. For such a purpose, the top faces of the bowling lanes must always be cleaned and conditioned by an oil treatment to have a very thin film of conditioning oil.

To this end, the applicant had proposed "a cleaning mechanism for bowling lane maintenance machines" as set forth in Japanese Utility Model Application No. 60-50769/1985. A similar cleaning mechanism is disclosed in U.S. Pat. No. 3,604,037.

Such cleaning mechanisms comprise a cleaning roller for cleaning and conditioning the top face of a bowling lane before applying oil thereto, an oil applying roller and a buffing roller.

These rollers are separately driven from respective drive motors. The cleaning roller is brought into contact with the top face of the bowling lane under a relatively low pressure while the buffing roller must contact the top face of the bowling lane under a relatively high pressure.

In the past, almost all the rollers were in the form of a straight roller which has its invariable diameter between the opposite ends of the roller. If such a straight roller is urged onto a flat surface with a very high pressure at the opposite ends of the roller, the latter is insufficiently engaged by the top face of a bowling lane particularly at the central portion of the roller along the length thereof. This results in buffing, cleaning and other operations which are not uniform in the width direction of the bowling lane.

Usually, the outer periphery of such rollers is covered with a cloth and/or a resilient material such that the outer roller periphery can self-adjust to some degree relative to irregularities of the top lane face, curvature of the roller and irregular pressures. If a pressing roller having a reduced diameter is used, however, it is difficult to increase the rigidity of the entire roller and also to produce the roller more simply and inexpensively.

More particularly, a prior art cleaning roller of such a construction as shown in FIG. 2 is rotatably driven to wipe off a film of oil while applying the oil to floor face of a bowling lane. The cleaning roller 1 comprises a core 2 in the form of a straight bar and a resilient body 3 mounted about the core. The resilient body 3 has ends each of which is spaced inwardly from the corresponding end of the core 2. The intermediate portion of the resilient body 3 between the opposite ends thereof has an invariable external diameter over the length of the resilient body 3. When a large force shown by F in FIG. 3 is simultaneously exerted on each of the opposite ends of the core 2, the roller core 2 is curved upwardly as shown in FIG. 2. In such a case, the contact pressure will be reduced at the central portion of the roller 1 rather than the opposite ends thereof, resulting in non-uniform contact.

SUMMARY OF THE INVENTION

It is therefore an object of the present invention to provide a cleaning roller which can be engaged by the top face of a bowling lane with the same contact pressure through the overall length of the roller even if the core is bent.

As the result of trial and error, the inventor has come to the following conclusion:

With a roller adapted to be brought into contact with the top face of a bowling lane under high pressure as a wiping-off roller and not capable of being supported at the intermediate position between the opposite ends of the roller in the width direction of the bowling lane, it is desirable to provide means for correcting the bending of the central portion of the roller under the influence of the downwardly pressing force.

To this end, the present invention overcomes the above-mentioned problem by adjusting and changing the thickness of the resilient body rather than that of the metallic core throughout the length of the roller.

In such a case, the variable thickness of the resilient body about the core must not disturb any uniform contact of the roller with the top face of the bowling lane.

The inventor reached an idea in which it is preferred that the thickness of the resilient body about the roller core is varied by an amount corresponding to the deformation of the roller core when urged against the top lane face with under high pressure.

As a result, the central portion of the roller could wipe off the cleaning oil from the top face of the bowling lane into a degree equal to or substantially equal to the wiping-off at the opposite ends of the roller.

Therefore, the present invention provides a cleaning roller rotatably driven to wipe off a liquid cleaner being applied to a floor by an applying roller, the cleaning roller comprising a core rotatably supportable at the opposite ends thereof and a resilient body mounted about the core and having one end inwardly spaced away from each of the opposite ends of the core, the external diameter of the resilient body having progressively increased from each of the opposite ends of the resilient body toward the central portion thereof.

DETAILED DESCRIPTION OF THE PREFERRED EMBODIMENT

Figure 1:
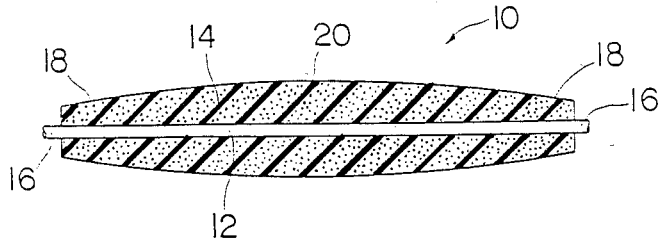
FIG. 1 is a longitudinal cross-section of a cleaning roller constructed in accordance with the present invention.
Figure 2:
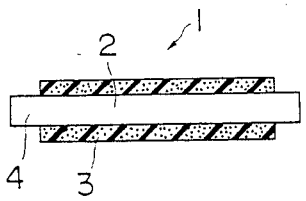
FIG. 2 PRIOR ART
FIG. 2 is a longitudinal cross-section of a cleaning roller constructed in accordance with the prior art.
Figure 3:
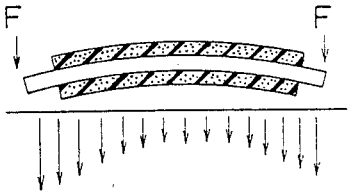
FIG. 3 PRIOR ART
FIG. 3 illustrates the prior art cleaning roller of FIG. 2 when forces are exerted on the roller at the opposite ends thereof.

The present invention will now be described in detail with respect to one embodiment thereof illustrated in the drawings.

Referring to FIG. 1, there is shown a cleaning roller 10 constructed in accordance with the present invention. The cleaning roller 10 comprises a core 12 which is in the form of an elongated bar. The opposite ends of the core 12 are rotatably supported by support means (not shown) and adapted to be urged against a flat surface such as a floor or the like by any suitable depressing means (not shown).

A resilient body 14 made of sponge or cloth is mounted about the core 12. The resilient body 14 has one end 18 spaced inwardly away from each end 16 of the core 12. The external diameter of the resilient body 14 is progressively increased from each of the ends 18 toward the central portion 20 of the resilient body 14. As shown, the central portion 20 may have a constant diameter throughout length.

Although the description has been made to the cleaning roller having the core covered with a resilient material such as sponge and/or cloth, a cleaning roller which is not covered with the resilient material may provide the same advantage if the roller is of such a configuration as described hereinbefore. For example, any non-covered metal roller having its external diameter increased from each end toward the central portion may similarly be applied to the depression of a continuous cloth and/or resilient material layer without any particular means and in a very simple and inexpensive manner.

EXAMPLE

In order to clarify the construction and advantage of the present invention, some examples will be described below.

Figure 4:
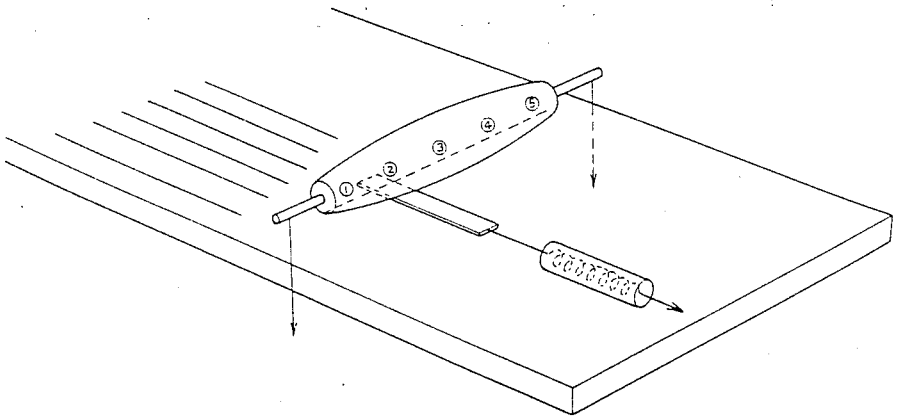
FIG. 4 is a schematic diagram of a cleaning roller according to one embodiment of the present invention during a test.

As shown in FIG. 4, a roller consisted of an aluminum tube having 3 cm diameter, 1.5 mm thickness and 1.1 m length and a rubber-sponge layer mounted about the aluminum tube and having a JIS rubber hardness equal to 15 degrees. The rubber-sponge layer had a central portion having a length equal to 20 cm and a thickness equal to 10 mm and linearly tapered from each end of the central portion toward each end of the rubber-sponge layer which had a thickness equal to 6 mm.

In comparison, there was provided a comparative roller consisting of an aluminum tube with the same external diameter and a sponge-rubber layer mounted about the aluminum tube and having a uniform thickness equal to 10 mm through the overall length equal to 1.1 m.

During test, each of the two rollers was placed on and across the top face of a bowling lane. A weight equal to 10 kg was then hung from each of the ends of each roller extending outwardly from each side edge of the bowling lane. Thereafter, a metal strip having 10 cm length, 1.5 cm width and 1.5 mm thickness was inserted at various positions between the top lane face and each of the rollers. A resistance created when the metal strip was drawn out between the top lane face and that roller was measured by the use of any suitable means. The results are shown in Table 1.

TABLE 1

| Distance from One End | The Invention | Comparative Roller |
|---|---|---|
| 5 cm | 280 g | 720 g |
| 30 cm | 300 g | 150 g |
| 55 cm | 320 g | 150 g |
| 80 cm | 280 g | 150 g |
| 105 cm | 300 g | 680 g |

As seen from Table 1, the roller of the present invention has a particularly remarkable advantage in such rollers as wiping rollers which must be pressed under higher pressures.

Although the illustrated embodiment of the present invention has been described as to the roller covered with a rubber-sponge material, the material used to cover the core of the roller is not limited to such a foam material. For example, the resilient material may include a foamed layer only in the surface or intermediate layer.

The roller is not necessary to have the linear and progressive taper from each of the ends toward the central portion of the roller. The central portion is not necessary to have a uniform external diameter.

It will be apparent that various modifications and changes may be made to the illustrated embodiment of the present invention withoug departing from the spirit and scope of the invention as defined in the appending claims.

I claim:

1. A cleaning roller rotatably driven to wipe off a liquid cleaner being applied to a floor, said cleaning roller comprising an elongated core rotatably supportable at the opposite longitudinal ends thereof and an elongated resilient body mounted about said core, said resilient body being made of a cleaning material operable to wipe off said liquid cleaner from said floor and to effect a cleaning action on said floor, said resilient body having a central portion and longitudinal ends inwardly spaced away from each of the opposite longitudinal ends of said core, the external diameter of said resilient body progressively increasing from each of the opposite longitudinal ends of said resilient body toward said central portion to thereby provide for substantially equal pressure contact between said floor and said resilient body along substantially the entire longitudinal length of said resilient body.

2. A cleaning roller according to claim 1, wherein the hardness of said resilient body has a JIS rubber hardness of between 10 and 40 degrees.

3. A cleaning roller according to claim 1, wherein said resilient body comprises a cleaning sponge material.

4. A cleaning roller according to claim 1, wherein said core comprises a metal tube, and said resilient body comprises a rubber sponge material.

5. A cleaning roller according to claim 1, wherein said central portion of said resilient body has a first diameter, each of said longitudinal ends of said resilient body having a common second diameter, said second diameter being about two-thirds of said first diameter.

6. A cleaning roller according to claim 5, wherein said central portion of said resilient body has a thickness of about 10 mm, and the longitudinal ends of said resilient body have a thickness of about 6 mm.

7. A cleaning roller according to claim 1, wherein said central portion of said resilient body has central portion ends spaced from one another, said central portion having a substantially constant diameter between said spaced central portion ends, the external diameter of said resilient body progressively increasing from said longitudinal ends of said resilient body to said central portion ends.

8. A cleaning roller according to claim 7, wherein the external diameter of said resilient body progressively and linearly increases from said longitudinal ends of said resilient body to said central portion ends.

* * * * *